US006343980B1

(12) United States Patent
Abe et al.

(10) Patent No.: US 6,343,980 B1
(45) Date of Patent: Feb. 5, 2002

(54) FLATTENING MACHINE

(75) Inventors: Kohzo Abe, Annaka; Yutaka Koma, Tokyo, both of (JP)

(73) Assignees: Supersilicon Crystal Research Institute Corporation; Disco Corporation, both of (JP)

( * ) Notice: Subject to any disclaimer, the term of this patent is extended or adjusted under 35 U.S.C. 154(b) by 0 days.

(21) Appl. No.: 09/403,961

(22) PCT Filed: Feb. 5, 1999

(86) PCT No.: PCT/JP99/00491

§ 371 Date: Nov. 1, 1999

§ 102(e) Date: Nov. 1, 1999

(87) PCT Pub. No.: WO99/44787

PCT Pub. Date: Sep. 10, 1999

(30) Foreign Application Priority Data

Mar. 3, 1998 (JP) ..... 10-051042

(51) Int. Cl.[7] ..... B24B 7/22

(52) U.S. Cl. ..... 451/292; 451/340

(58) Field of Search ..... 451/292, 411, 451/41, 403, 401, 288, 287, 285, 340, 363, 332

(56) References Cited

U.S. PATENT DOCUMENTS 5,718,619 A * 2/1998 Merrill et al. ..... 451/41
5,784,932 A * 7/1998 Gilberti ..... 74/813 R
5,950,503 A * 9/1999 Amendolea ..... 74/813 R

FOREIGN PATENT DOCUMENTS

| | | |
|---|---|---|
| JP | 05309535 | 11/1993 |
| JP | 06155257 | 6/1994 |
| JP | 08276358 | 10/1996 |
| WO | 99044787 | 9/1999 |

* cited by examiner

*Primary Examiner*—Robert A. Rose
(74) *Attorney, Agent, or Firm*—Webb Ziesenheim Logsdon Orkin & Hanson, P.C.

(57) ABSTRACT

Three columns 10, 20, 30 are set up in an approximately triangle arrangement. A saddle 51, which fixes a main spindle 50 thereto, is held in contact with a side face of the column 10, 20 or 30 or a brace 40 which unitarily connects two or three of the columns 10, 20, 30. A plurality of chucking tables 4*a*, 4*b* are installed in an indexing table 2*a*. When a work piece 5*b* attracted onto one chucking table 4*b* is carried to a position below the main spindle 50, the other chucking table 4*a* is located at a loading-unloading position. Since the main spindle 50 is located at a geometrical gravity center of a triangle defined by the columns 10, 20, 30, a reaction force which is generated during machining is uniformly distributed to each of the columns 10, 20, 30. Consequently, the columns 10, 20, 30 are prevented from deformation which causes inclination of the main spindle 50, and the machined work piece has superior flatness.

7 Claims, 4 Drawing Sheets

FLATTENING MACHINE

BACKGROUND OF THE INVENTION

The present invention relates to a flattening machine for grinding or polishing a disc-shaped work piece such as a semiconductor wafer or a glass disc.

1. Field of the Invention

A conventional vertical spindle type surface grinding machine has a grinding wheel fixed to a slider which is provided movably along a column of a cantilever or gantry-type frame. The grinding wheel is fed along a vertical axis by cylindrical linear actuator, a ball screw or the like so as to descend the slider.

2. Brief Description of the Prior Art

When the slider which a main spindle is fixed thereto is fed along the column of the cantilever-type frame, the slider is likely to take pitching or yawing motion with respect to a guide way of the column due to disturbances such as offset between the guide way and the slider or fluctuation of an external force applied to the slider. Such motion causes even slight inclination of the main spindle. Thermal unbalance also causes inclination of the main spindle. Due to the inclination of the main spindle, the grinding wheel irregularly deviates from a position facing to a work piece, so as to deteriorate dimensional accuracy of a ground work piece such as a semiconductor wafer or an optical glass disc which is expected to be finished with high flatness.

Inclination of the main spindle occurs, when a central axis of a guide way system, a direction of a driving force of a slider feeding member and a rotation axis of the main spindle are not aligned on the same line.

In this regard, Japanese Patent Application Laid-Open 8-276358 proposed the structure that a direction of a driving force of a slider feeding member is held on nearly the same line with a central axis of a guide way. According to this structure, a slider is hardly inclined with respect to a feeding direction. Even when the slider is inclined, its inclination angle is suppressed to a small value. In addition, a rotation axis of a grinding wheel is preferably aligned on nearly the same line with a scale line of a detector for detecting a position of the grinding wheel. Such alignment enables accurate detection of a position of the grinding wheel without substantial errors even when the main spindle is inclined.

Japanese Patent Application Laid-Open 6-155257 proposed the structure that a tripodal outer frame for supporting a main spindle is supported at the apex of a trigonal pyramid under the condition that a direction of a resultant of machining forces applied to the grinding wheel is aligned with a rotation axis. According to this structure, a supporting member for the grinding wheel can be designed to a constitution rigid enough to suppress distortion or deformation caused by various machining forces to a minimum level. A rotation axis of a motor for rotating a work piece and a grinding wheel can be concentrically aligned with axes of the work piece and the grinding wheel, so as to effectively eliminate bending moments or vibrations which likely occur during feeding.

However, when a center line of a guide way, a direction of a driving force of a slider feeding system, a rotation axis of a grinding wheel and a scale line of a detector for detecting a position of a grinding wheel are aligned on the same line as disclosed in Japanese Patent Application Laid-Open 8-276358, the grinding wheel is located at a position surrounded with a gantry-type frame at both sides.

Therefore, troublesome operations are obliged to maintain and check the grinding wheel, and a space necessary for changing an abraded grinding wheel to a new one is hardly kept. Consequently, it is difficult to improve both performance of the grinding machine and workability during change of grinding wheels. Frontward or backward inclination of a main spindle also puts harmful influences on grinding results, since the main spindle is supported with the gantry-type frame having tow columns standing up on a bed.

On the other hand, with a grinding machine wherein supporting columns are constructed to a trigonal pyramid as disclosed in Japanese Patent Application Laid-Open 6-155257, it is impossible to design the trigonal pyramid frame so as to support a main spindle unit with an area broad enough to guarantee the stiffness necessary for supporting the main spindle. Inferior stiffness causes inclination of the main spindle and deterioration of dimensional accuracy of a ground work piece, especially when a wafer or the like is machined by a rotary grinder which is likely to be affected by an unbalanced load.

SUMMARY OF THE INVENTION

The present invention is aimed at machining wafers or the like to precisely flattened surface with extremely high accuracy while inhibiting inclination of a main spindle. The precise working is attained by setting the main spindle at a geometric gravity center of a triangle defined by three columns which are located near a work piece loading-unloading equipment, so as to uniformly distribute machining force to each of the three columns during machining and to hold a space necessary for operations such as maintenance and checking, change of work pieces.

The flattening machine according to the present invention comprises three columns set up in triangular relationship, a saddle which can move along a vertical direction in state direct or indirect contact with a side face of one column, a main spindle fixed to the saddle at a position equal to a geometrical gravity center of a triangle defined by the three columns, and an indexing table which provides a plurality of chucking tables thereon. When a single or a plurality of chucking tables carries a work piece(s) at a position below the saddle, the other chucking table(s) is located at a loading-unloading position(s).

The indexing table may be either a rotary or reciprocative type. In the case where the indexing table is a rotary type, one of the three columns may be set up through a central opening of the indexing table, while the other two columns are set up near a periphery of the indexing table. In another case of rotary type, two columns may be constructed to a gantry-type frame encompassing a rotary indexing table which is located at a position on a loading-unloading line. In the case where the indexing table is a reciprocative type, two columns are constructed to a gantry-type frame, and the indexing table is provided in reciprocative state between the gantry-type frame and the rest column.

The other features of the present invention will be apparent from the following explanation consulting with the attached drawings.

DETAILED DESCRIPTION OF THE PREFERRED EMBODIMENTS

A flattening machine according to the present invention is designed to a proper structure in response to stock removal of a work piece, surface condition of a work piece before machining, objective flatness to be attained by machining, performance of the machine, etc.

Figure 1:
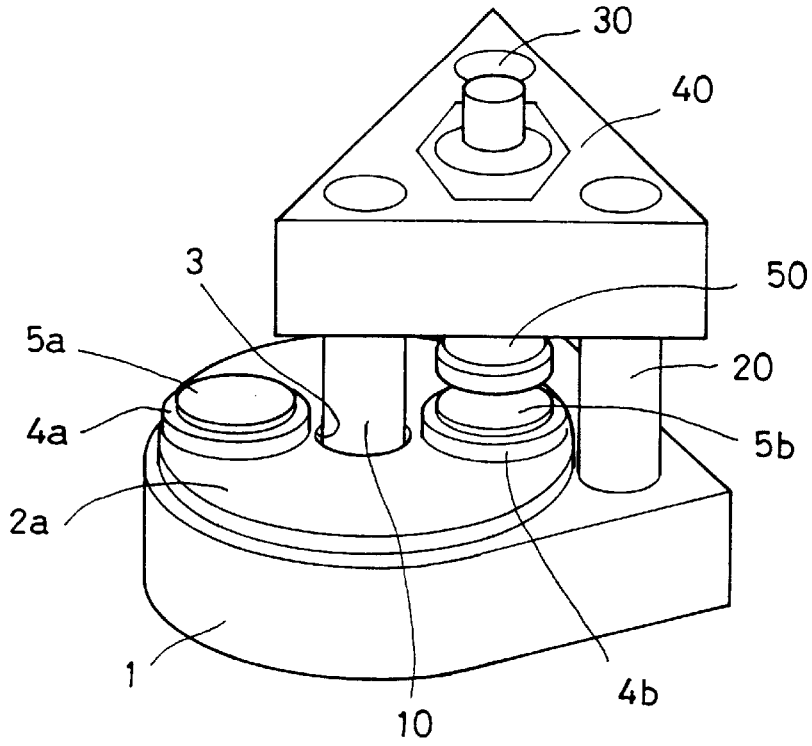
FIG. 1 is a perspective view illustrating a flattening machine having three columns, one of which is set up at a center of a rotary indexing table.

A basic structure of the flattening machine shown in FIG. 1 has an indexing table 2*a* provided on a bed 1. An opening 3 extending along a vertical direction is formed at a center of the indexing table 2*a*. A first column 10 is set up through the opening 3. A second column 20 and a third column 30 are set up as the remaining two columns near a periphery of the indexing table 2*a*. At least two chucking tables 4*a*, 4*b* are installed on the indexing table 2*a*, so as to hold work pieces 5*a*, 5*b*, respectively. FIG. 1 shows the state that the chucking table 4*a* is at a loading-unloading position, while the other chucking table 4*b* is at a machining position. A wafer 5*b* chucked to the chucking table 4*b* is machined, while another wafer 5*a* is loaded onto or unloaded from the chucking table 4*a*.

Figure 7:
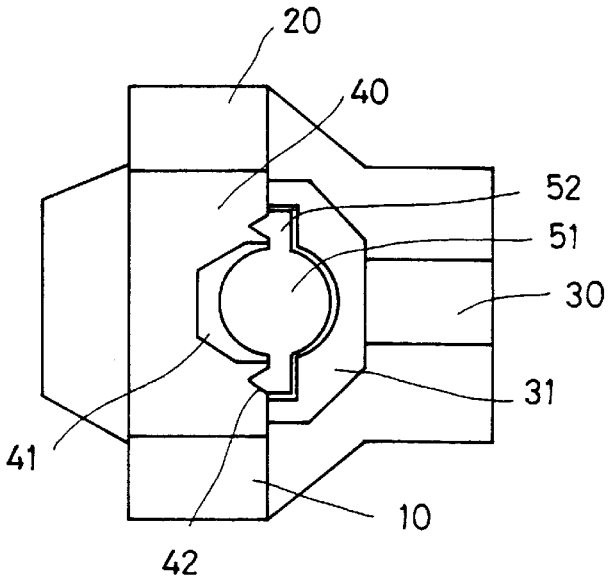
FIG. 7 is a horizontal sectional view of the flattening machine shown in FIGS. 5 and 6 along a plane passing through a saddle.

The columns 10, 20 and 30 are unitarily connected at their upper parts with a brace 40. Such connection of the three columns 10, 20, 30 enhances stiffness of the structure along every direction. A saddle 51, to which a main spindle 50 is fixed thereto as shown in FIG. 7, is provided in state movable along a vertical direction at the brace 40. The main spindle 50 is located at a geometrical gravity center of a triangle defined by the columns 10, 20 and 30. Such location of the main spindle 50 enables uniform distribution of machining force, which is generated during machining the work piece 5*b*, to each of the columns 10, 20, 30, so as to inhibit deformation of the columns 10, 20, 30 which would cause inclination of the main spindle 50.

A plurality of main spindles may be installed instead of a single main spindle. For instance, a flattening machine shown in FIG. 2 has three chucking tables 4*a*, 4*b*, 4*c* installed in an indexing table 2*a*, and two main spindles 50*b*, 50*c* provided at a brace 40. This flattening machine has four columns to constitute two triangles. That is, each triangle is constituted by two common columns and one remainder column. The main spindles 50*b*, 50*c* are located at the gravity centers of the two triangles, respectively.

The main spindle 50*b* may be used for rough machining, while the other main spindle 50*c* may be used for finishing. A grinding wheel 53 for each purpose is fixed to each of the main spindles 50*b* and 50*c*. Each chucking table 4*a*, 4*b*, 4*c* is successively moved to a loading position, a rough machining position, a finishing position and then an unloading position by intermittent rotation of the indexing table 2*a* with every angle of 120 degrees. Since the rough machining and finishing operations are performed in series, work pieces 5*a*, Sb, 5*c* are effectively ground to objective flatness in a short period of time.

Figure 3:
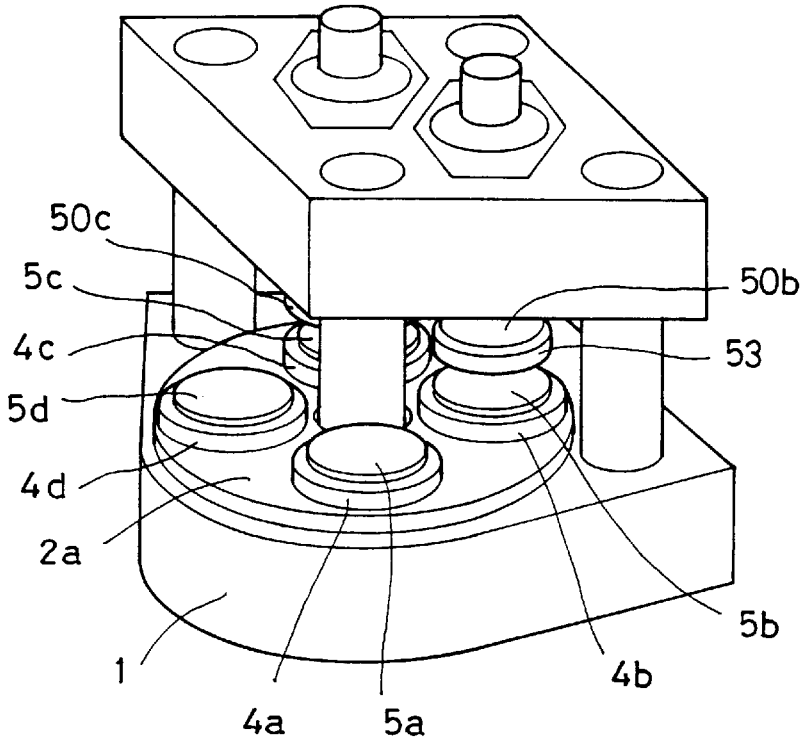
FIG. 3 is a perspective view illustrating a flattening machine having two main spindles and four chucking tables.

Furthermore chucking tables may be provided, as far as the indexing table 2*a* has a capacity necessary for provision of several chucking tables. For instance, FIG. 3 shows provision of four chucking tables 4*a* to 4*d* on an indexing table 2*a*. The same grinding wheels 53 are fixed to main spindles 50*b*, 50*c*. The chucking tables 4*a* and 4*c* make one couple, while the chucking tables 4*b* and 4*d* make the other couple. The indexing table 2*a* is intermittently rotated every angle of 180 degrees, so as to attain double performance compared with the flattening machine shown in FIG. 1.

Figure 4:
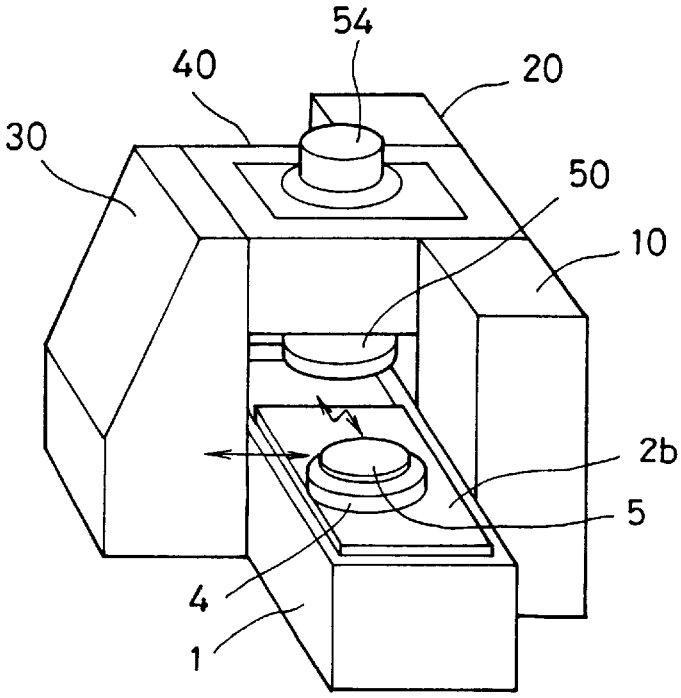
FIG. 4 is a perspective view illustrating a flattening machine having a reciprocative indexing table.

A reciprocative indexing table 2*b* may be installed in the flattening machine according to the present invention, as shown in FIG. 4. A first column 10 and a second column 20 are located at one side of the indexing table 2*b*, while a third column 30 is located at the opposite side. These columns 10, 20, 30 are unitarily connected together with a brace 40 having sides fixed to upper parts of the columns 10, 20, 30, so as to construct a triangular frame superior in stiffness. A saddle 51 (shown in FIG. 7) is provided at the brace 40, in the manner such that a main spindle 50 is located at a geometrical gravity center of a triangle defined by the columns 10, 20 and 30.

Since the structure shown in FIG. 4 allows connection of the columns 10, 20, 30 to a bed 1 with a broad touch area, the flattening machine as a whole exhibits superior stiffness. Due to the superior stiffness, the flattening machine keeps its original profile against big machining force which is generated during machining a big-size work piece 5 without inclination of the columns 10, 20, 30. As a result, excellent machining accuracy is assured under stable conditions.

Figure 2:
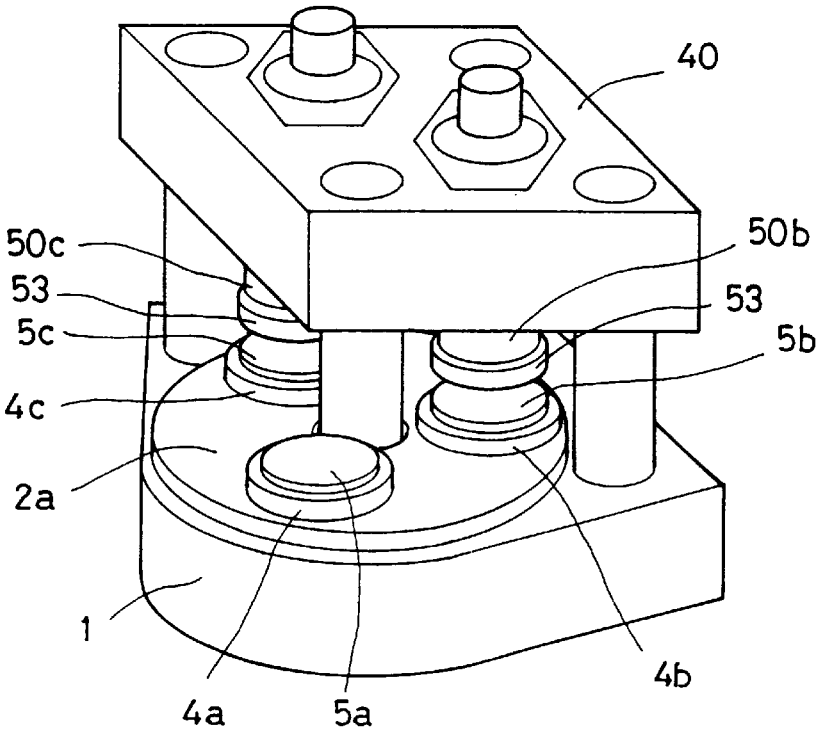
FIG. 2 is a perspective view illustrating a flattening machine having two main spindles and three chucking tables.

The reciprocative indexing table 2*b* enhances freedom of design and installation of surroundings around the indexing table 2*b*, compared with a rotary indexing table 2*a* (as shown in FIGS. 1–3). In case of the rotary indexing table 2*a*, since vacuum for attracting work pieces 5*a* –5*c* with chucking tables 4*a* –4*d* as well as a driving force for rotating chucking tables 4*a* –4*d* must be transmitted to the indexing table 2*a* through a rotary joint or the like, vacuum piping and driving means likely restrict arrangement of parts, resulting in elevation of an assembly cost. On the other hand, vacuum piping and driving means are directly communicated with the chucking table 4 installed in the reciprocative indexing table 2*b* outside the machine, so that the flattening machine superior in stiffness can be offered at a low cost.

Another type of reciprocative indexing table 2*b* may be located between first and second columns 10, 20 and a third column 30 shown in FIGS. 1–3, when there is sufficient space between the first and second columns 10, 20 and the third column 30. Such reciprocative indexing table 2*b* performs advantages both of the rotary and reciprocative types.

Figure 5:
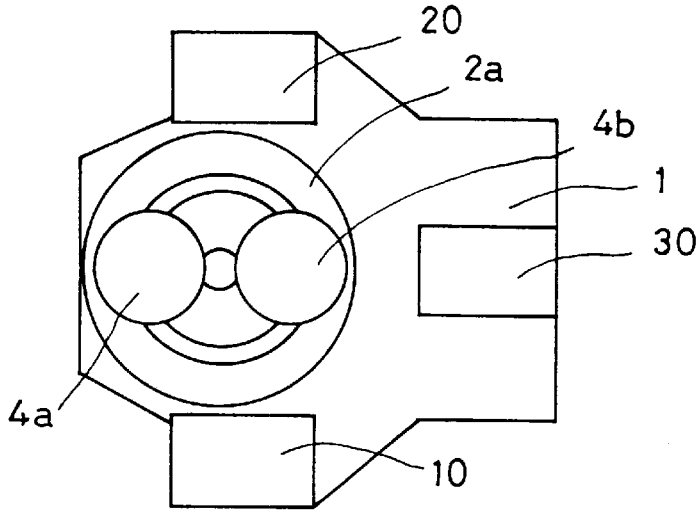
FIG. 5 is a plan view illustrating the positional relationship of a rotary indexing table with three columns near a bed of a flattening machine.

The constitution and function of the flattening machine will be concretely explained, as for the flattening machine having two columns 10, 20 located at opposite sides of a rotary indexing table 2*a* as shown in FIG. 5. Due to such location of the columns 10, 20, enlargement of the indexing table 2*a* in size is avoided, and the flattening machine is designed in compact size compared with the constitution shown in FIG. 1.

Figure 6:
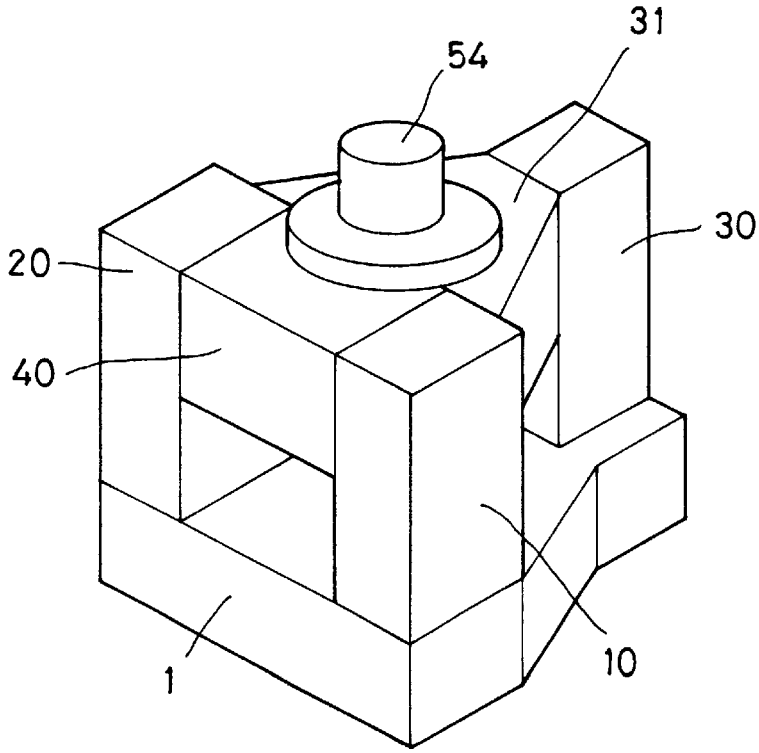
FIG. 6 is a perspective view illustrating the flattening machine shown in FIG. 5.

The first column 10 and the second column 20 are located at opposite sides of the rotary indexing table 2*a* on a bed 1 as shown in FIG. 5, and unitarily connected together at their upper parts with a brace 40 as shown in FIG. 6, so as to construct a gantry-type frame superior in stiffness. A horizontally directed dent is formed at a center of a side face of the brace 40, as shown in FIG.7. The dent is used as a part of a space 41 for receiving a saddle 51. V-shaped grooves 42 extending along a vertical direction at both sides of the saddle receiving space 41 are formed at the side face of the brace 40.

V-shaped ridges 52, which are inserted into corresponding V-shaped grooves 42, are formed at the saddle 51. The saddle 51 is pressed onto the first and second columns 10, 20 by press means incorporated in a second brace 31 fixed to a third column 30. The V-shaped ridges 52 are inserted into the corresponding V-shaped grooves 42 by pressing the saddle 51, and location of a main spindle 50 fixed to the saddle 51 is determined at a geometrical gravity center of a triangle defined by columns 10, 20, 30.

The saddle 51 held in this way is located at a position above an outside radius part of a chucking table 4*b* installed in an indexing table 2*a* as shown in FIG. 5. The other chucking table 4*a* is located at a loading-unloading position in front of the first and second columns 10, 20.

Figure 8A:
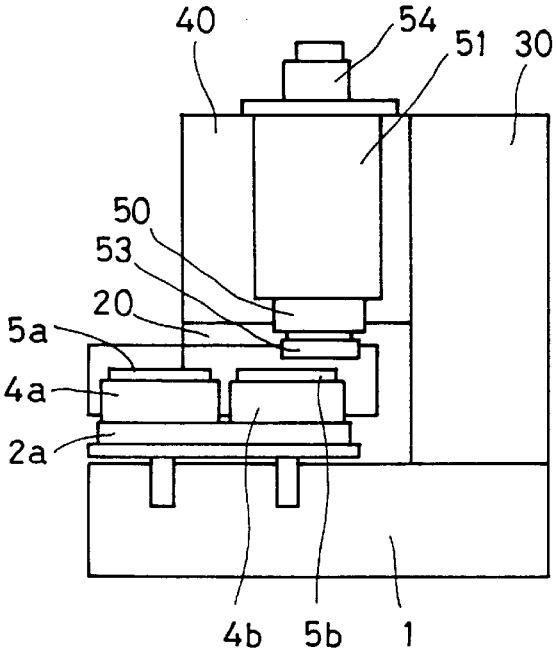
FIG. 8A is a side sectional view of the flattening machine shown in FIGS. 5 and 6.
Figure 8B:
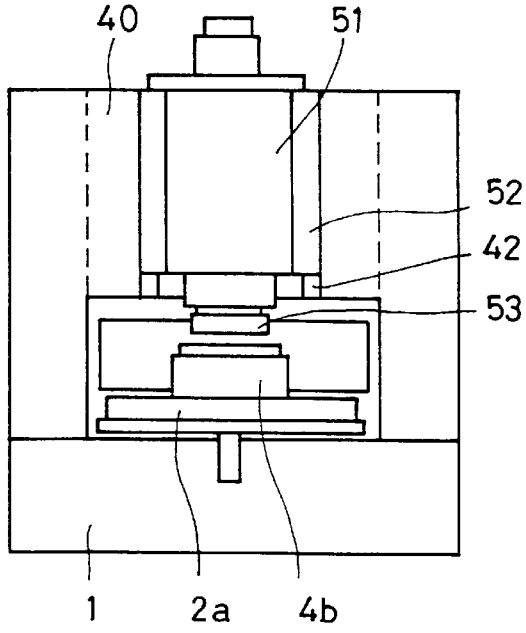
FIG. 8B is a front view of the flattening machine shown in FIGS. 5 and 6.

A main spindle 50 having a lower end to which a grinding wheel 53 is fixed is provided at the saddle 51, as shown in FIG. 8A. A hydraulic cylinder 54 as a linear actuator is mounted on the saddle 51. V-shaped grooves 42 are formed at a side face of the brace 40 along a distance between upper and lower ends of the brace 40, as shown in FIG. 8B which is a view illustrating the saddle 51 and the brace 40 from the side of the third column 30. Each V-shaped groove 42 offers a broad guide face for guide of the saddle 51 through V-shaped ridges 52. The broad guide face in co-operation with the tripodal structure effectively improves stiffness of the machine as a whole.

A work piece 5*a* is mounted on or taken off the chucking table 4*a* by a loading-unloading manipulator (not shown). The mounted work piece 5*a* is attracted onto the chucking table 4*a* and carried to a position below the saddle 51 by rotation of the indexing table 2*a*.

The work piece 5*b* at the position below the saddle 51 is rotated at a high speed by rotation of the chucking table 4*b* and machined with a predetermined depth of cut by a grinding wheel 53. During machining, the saddle 51 is fed downwards along the V-shaped grooves 42 by the hydraulic cylinder 54, so as to perform cutting motion.

In the flattening machine according to the present invention, three columns 10, 20, 30 are unitarily connected together with the brace 40 to construct a tripodal gantry-type frame, and the main spindle 50 is located at a geometrical gravity center of a triangle defined by the columns 10, 20, 30. Due to this constitution, a machining force applied to the main spindle 50 during machining is uniformly distributed to each of the columns 10, 20, 30, without inclination of columns which often occurs in a conventional cantilever-type frame. The saddle 51 is held in contact with the brace 40 with a broad touch area due to insertion of the V-shaped ridges 52 into the V-shaped grooves 42. Consequently, the main spindle 50 fixed to the saddle 51 is held with extremely high stiffness without inclination even when a great reaction force is applied during machining, so that the work piece 5*b* is finished to surface conditions superior in flatness.

The flattening machine according to the present invention as above-mentioned has a main spindle located at a geometrical gravity center of a triangle defined by three columns, so as to uniformly distribute a machining force to each of the columns during grinding or polishing and to inhibit inclination of columns which causes deflection or eccentricity of the main spindle. In addition, since the saddle is held in direct or indirect contact with a brace with a broad touch area, the saddle is fed downwards or upwards without substantial change of its attitude to the column. Therefore, a machined work piece has superior flatness.

What is claimed is:

1. A flattening machine comprising:

three columns vertically set up to construct a triangular prism-shaped frame;

a saddle movable along a vertical direction in contact with a side face of one of said columns or a brace which unitarily connects two or three of said columns at their upper parts;

a main spindle fixed to said saddle at a geometrical gravity center of the triangular frame defined by said columns; and an indexing table with a plurality of chucking tables installed thereon;

wherein a work piece on at least one of said chucking tables is located below said main spindle, while at least one other of said chucking tables is located at a loading-unloading position.

2. The flattening machine as claimed in claim 1, wherein the indexing table is of a rotary type, and one of the three columns is set up through a central opening of said rotary indexing table, while the remaining columns are set up near a periphery of said indexing table.

3. The flattening machine as claimed in claim 1, wherein the indexing table is of a reciprocative type, two of the three columns are constructed to a gantry-type frame encompassing said reciprocative indexing table, and said reciprocative indexing table is located between the gantry-type frame and the remaining column.

4. The flattening machine as claimed in claim 1, wherein the indexing table is of a rotary type, two of the three columns are unitarily connected with the brace to construct a gantry-type frame encompassing said rotary indexing table, and the saddle is pressed onto said gantry-type frame by press means provided at a remaining column.

5. A flattening machine comprising:

three columns set up in a substantially triangular arrangement;

a saddle movable along a vertical direction in contact with a side face of one of said columns or a brace which unitarily connects two or three of said columns at their upper parts;

a main spindle fixed to said saddle at a geometrical gravity center of a triangle defined by said columns; and an indexing table with a plurality of chucking tables installed thereon;

wherein a work piece on at least one of said chucking tables is located below said main spindle, while at least one other of said chucking tables is located at a loading-unloading position;

and wherein the indexing table is of a rotary type, and one of the three columns is set up through a central opening of said rotary indexing table, while two of the three columns are set up near a periphery of said indexing table.

6. A flattening machine comprising:

three columns set up in a substantially triangular arrangement;

a saddle movable along a vertical direction in contact with a side face of one of said columns or a brace which unitarily connects two or three of said columns at their upper parts;

a main spindle fixed to said saddle at a geometrical gravity center of a triangle defined by said columns; and an indexing table with a plurality of chucking tables installed thereon;

wherein a work piece on at least one of said chucking tables is located below said main spindle, while at least one other of said chucking tables is located at a loading-unloading position;

and wherein the indexing table is of a reciprocative type, two of the three columns are constructed to a gantry-type frame encompassing said reciprocative indexing table, and said reciprocative indexing table is located between said gantry-type frame and a remaining column.

7. A flattening machine comprising:

three columns set up in a substantially triangular arrangement;

a saddle movable along a vertical direction in contact with a side face of one of said columns or a brace which unitarily connects two or three of said columns at their upper parts;

a main spindle fixed to said saddle at a geometrical gravity center of a triangle defined by said columns; and an indexing table with a plurality of chucking tables installed thereon;

wherein a work piece on at least one of said chucking tables is located below said main spindle, while at least one other of said chucking tables is located at a loading-unloading position;

and wherein the indexing table is of a rotary type, two of the columns are unitarily connected with the brace to construct a gantry-type frame encompassing said rotary indexing table, and the saddle is pressed onto said gantry-type frame by press means provided at a remaining column.

* * * * *